US011396713B2

(12) United States Patent
Marmann et al.

(10) Patent No.: US 11,396,713 B2
(45) **Date of Patent: *Jul. 26, 2022**

(54) METHOD FOR THE PRODUCTION OF A METAL STRIP COATED WITH A COATING OF CHROMIUM AND CHROMIUM OXIDE USING AN ELECTROLYTE SOLUTION WITH A TRIVALENT CHROMIUM COMPOUND

(71) Applicants: thyssenkrupp Rasselstein GmbH, Andernach (DE); thyssenkrupp AG, Essen (DE)

(72) Inventors: Andrea Marmann, Piesport (DE); Christoph Molls, Bonn (DE)

(73) Assignees: thyssenkrupp Rasselstein GmbH, Andernach (DE); thyssenkrupp AG, Essen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/711,703

(22) Filed: Dec. 12, 2019

(65) Prior Publication Data

US 2020/0190684 A1 Jun. 18, 2020

(30) Foreign Application Priority Data

Dec. 13, 2018 (DE) ..... 10 2018 132 074.4

(51) Int. Cl.
*C25D 7/06* (2006.01)
*C25D 3/06* (2006.01)
*C25D 17/02* (2006.01)

(52) U.S. Cl.
CPC ..... *C25D 7/0614* (2013.01); *C25D 3/06* (2013.01); *C25D 17/02* (2013.01)

(58) Field of Classification Search
None
See application file for complete search history.

(56) References Cited

U.S. PATENT DOCUMENTS 3,316,160 A 4/1967 Uchida et al.
10,422,049 B2 9/2019 Wijenberg
(Continued)

FOREIGN PATENT DOCUMENTS

EP 3112502 A1 1/2017
EP 3378973 A1 9/2018
(Continued)

OTHER PUBLICATIONS

Search Result for German Patent Application No. 10 2018 132 074.4 filed Dec. 13, 2018.
(Continued)

*Primary Examiner* — Wojciech Haske
(74) *Attorney, Agent, or Firm* — Paul D. Bianco; Katharine Davis; Fleit Intellectual Property Law

(57) ABSTRACT

A method for the production of a metal strip coated with a coating. The coating containing chromium metal and chromium oxide and is electrolytically deposited from an electrolyte solution that contains a trivalent chromium compound onto the metal strip by bringing the metal strip, which is connected as the cathode, into contact with the electrolyte solution. An effective deposition of the coating with a high chromium oxide portion is achieved by successively passing the metal strip at a predefined strip travel speed through a plurality of electrolysis tanks arranged successively in a strip travel direction. The first electrolysis tank is set to a low current density; a second electrolysis tank, which follows in the strip travel direction, is set to a medium current density; and a last electrolysis tank is set to a high current density, where the low current density is greater than 20 A/dm$^2$.

23 Claims, 4 Drawing Sheets

(56) References Cited

U.S. PATENT DOCUMENTS

| | | | | |
|---|---|---|---|---|
| 2015/0064494 | A1* | 3/2015 | Wijenberg | C25D 5/36 428/623 |
| 2016/0138178 | A1 | 5/2016 | Wijenberg | |
| 2017/0081773 | A1* | 3/2017 | Wijenberg | C25D 7/0621 |
| 2018/0320281 | A1 | 11/2018 | Mull | |
| 2020/0190679 | A1 | 6/2020 | Marmann | |

FOREIGN PATENT DOCUMENTS

| | | | |
|---|---|---|---|
| JP | 2016-528378 | A | 9/2016 |
| JP | 2017-519103 | | 7/2017 |
| WO | 2014/079909 | A1 | 5/2014 |
| WO | 2014079909 | A1 | 5/2014 |
| WO | 2014/202316 | A1 | 12/2014 |
| WO | 2015/177314 | A1 | 11/2015 |
| WO | 2015177314 | A1 | 11/2015 |
| WO | 2015177315 | A1 | 11/2015 |
| WO | 2018/087135 | A1 | 5/2018 |
| WO | 2018087135 | A1 | 5/2018 |

OTHER PUBLICATIONS

European Search Reports for European Application Nos. 19206950 and 19206952, dated Mar. 23, 2020.
Office Action dated Mar. 2021 for Korean Patent Application No. 10-2019-0165574 (English translation) (8 pages).
Office Action dated Jan. 26, 2021, for Japanese Patent Application No. 2019-221836 KEnglish translation) (2 pages).
European Search Report dated Apr. 1, 2020, for European Patent Application No. 19206950.8 (10 pages).
Response filed Aug. 26, 2021 for U.S. Appl. No. 16/711,859.
Office Action dated Jan. 21, 2021, for Japanese Patent Application No. 2019-221834 (English translation) (2 pages).
Office Action dated Mar. 18, 2021 for Korean Patent Application No. 10-2019-0165573 with translation.
For U.S. Appl. No. 16/711,859: Office Action dated May 25, 2021 Terminal Disclaimer filed Nov. 2, 2021 Notice of Allowance dated Nov. 10, 2021.
European Search Report dated Apr. 1, 2020, for European Patent Application No. 19206952.
Search result of examination report for German Patent Application No. 10 2018 132 075.2 filed Dec. 13, 2018.

* cited by examiner

METHOD FOR THE PRODUCTION OF A METAL STRIP COATED WITH A COATING OF CHROMIUM AND CHROMIUM OXIDE USING AN ELECTROLYTE SOLUTION WITH A TRIVALENT CHROMIUM COMPOUND

FIELD OF THE DISCLOSURE

The present disclosure relates to a method for the production of a metal strip coated with a coating.

BACKGROUND

It is known from the prior art that in the production of packaging materials, electrolytically coated sheet steel coated with a coating of chromium and chromium oxide can be used, which sheet steel is known as "Tin Free Steel" (TFS) or as "Electrolytic Chromium Coated Steel" (ECCS) and which is an alternative to tinplate. This tin-free steel is marked by an especially favorable adhesion for paints or organic protective coatings (for example, polymer coatings of PP or PET). In spite of the low thickness of the coating of chromium and chromium oxide, which, as a rule, is less than 20 nm, this chromium-coated sheet steel is marked by good corrosion resistance and good workability in deformation processes used in the production of packaging materials, for example, in deep drawing processes and ironing processes.

To coat the steel substrate with a coating containing metallic chromium and chromium oxide, it is known from the prior art that electrolytical coating methods can be used, by means of which the coating is applied onto strip-shaped sheet steel using a chromium (VI)-containing electrolyte in a strip coating system. Because of the environmentally harmful and health-threatening properties of the chromium (IV)-containing electrolytes used in the electrolytic process, however, these coating methods are fraught with considerable disadvantages and will have to be replaced in the not too distant future with alternative coating methods since the use of chromium (IV)-containing materials will soon be prohibited.

For this reason, electrolytic coating methods, which obviate the use of chromium (IV) containing electrolytes, have already been developed in the state of the art. For example, WO 2015/177314-A1 discloses a method for the electrolytic coating of strip-shaped sheet steel with a chromium metal/chromium oxide (Cr/CrOx) layer in a strip coating system in which the sheet steel, which is connected as the cathode, is passed at high strip travel speeds of more than 100 m/min through an electrolyte solution which contains a trivalent chromium compound (Cr(III)). It was observed that the composition of the coating—which, depending on the components other than the chromium metal and chromium oxide constituents contained in the trivalent chromium compound (Cr(III)) in the electrolyte solution, may in addition also contain chromium sulfates and chromium carbides—depends to a very great extent on the current densities of the electrolysis at the anodes that are set during the electrolytic deposition process in the electrolysis tanks in which the electrolyte solution is contained. It has been found that as a function of the current density, three regions (Regime I, Regime II and Regime III) form such that in a first region with a low current density up to a first current density threshold (Regime I), no chromium-containing deposition on the steel substrate takes place; in a second region with medium current density (Regime II), there is a linear relationship between the current density and the weight of the deposited coating; and that at current densities above a second current density threshold (Regime III), a partial decomposition of the deposited coating takes place, so that in this region, as the current density increases, the coating weight of chromium in the deposited coating initially decreases and subsequently settles to a steady value at higher current densities. In the region with a medium current density (Regime II), mainly metallic chromium of up to 80 wt % (relative to the total weight of the coating) is deposited on the steel substrate, and above the second current density threshold (Regime III), the coating contains a higher chromium oxide content, which in the region of the higher current densities amounts to between ¼ and ⅓ of the total deposited weight of the coating. The values of the current density thresholds which define the borders between the regions (Regime I to III) were found to be dependent on the strip travel speed at which the sheet steel is moved through the electrolyte solution.

As mentioned in WO 2014/079909 A1, to ensure that tin-free steel coated with a chromium/chromium oxide coating (uncoated sheet steel) has a sufficiently high corrosion resistance for use in packaging applications, a minimum coating weight of at least 20 mg/m$^2$ is required in order to achieve a corrosion resistance comparable to conventional ECCS. Furthermore, it was shown that to achieve a sufficiently high corrosion resistance suitable for use in packaging applications, the coating must have a minimum coating weight of chromium oxide of at least 5 mg/m$^2$. To ensure such a minimum coating weight of chromium oxide in the coating, it would appear useful to set high current densities in the electrolytic process so as to be able to work in the region (Regime III) in which a coating with a relatively high chromium oxide content can be deposited on the steel substrate. Accordingly, to obtain a coating with a high chromium oxide content, it would therefore be necessary to use high current densities. However, to achieve high current densities in the electrolysis tanks, a substantial amount of energy for the application of high currents to the anodes is required.

SUMMARY

One aspect of the present disclosure relates to an efficient and energy-saving method for the production of a metal strip coated with a coating of chromium and chromium oxide using an electrolyte solution with a trivalent chromium compound.

Preferred embodiments of such a method are also disclosed.

According to the disclosed method, a coating containing chromium metal and chromium oxide is electrolytically deposited from an electrolyte solution that contains a trivalent chromium compound onto a metal strip, especially a steel strip, by bringing the metal strip, which is connected as the cathode, into contact with the electrolyte solution, the metal strip being successively passed at a predefined strip travel speed in a strip travel direction through a plurality of electrolysis tanks, which are successively connected to each other in the strip travel direction, wherein the first electrolysis tank, as viewed in the strip travel direction, or a front group of electrolysis tanks, has a low current density $j_1$; a second electrolysis tank, following in the strip travel direction, or a middle group of electrolysis tanks, has a medium current density $j_2$; and a last electrolysis tank, as viewed in the strip travel direction, or a rear group of electrolysis tanks, has a high current density $j_3$, where $j_1 \leq j_2 < j_3$ and the low current density $j_1$ is greater than 20 A/dm$^2$.

The low current density $j_1 > 20$ A/dm$^2$ is selected such that in the first electrolysis tank or in the front group of electrolysis tanks, a coating containing chromium and/or chromium oxide is already deposited on the metal strip. The lower limit value of 20 A/dm$^2$ used for the current density allows chromium- and/or chromium oxide-containing coatings to be deposited even at low strip travel speeds (of, for example, v=100 m/min). To achieve a high throughput, strip travel speeds of v≥100 m/min are preferred.

By dividing the successively, in the strip running direction, arranged electrolysis tanks into groups and by setting different strip travel speeds in the individual electrolysis tanks, which strip travel speeds increase in the strip travel direction, it is possible to maintain high strip travel speeds of 100 m/min or more, on the one hand, and to deposit a coating with a sufficiently high coating weight on at least one side metal strip, on the other hand, with the coating having a chromium oxide content of at least 5 mg/m$^2$, preferably of more than 7 mg/m$^2$, required to ensure a sufficiently high corrosion resistance.

In this context, the term chromium oxide refers to all oxide forms of chromium (CrOx), including chromium hydroxides, in particular chromium(III) hydroxide and chromium(III) oxide hydrate, and mixtures thereof.

Due to the fact that in the first electrolysis tank or in the front group of electrolysis tanks and in the second electrolysis tank or in the middle groups of electrolysis tanks, the current densities $j_1$ and $j_2$ used, respectively, are lower when compared to the current density in the last electrolysis tank, as viewed in the strip travel direction, or in the rear group of electrolysis tanks, energy can be saved since lower electric currents are needed for application to the anodes in the first electrolysis tank or in the front group of electrolysis tanks and in the second electrolysis tank or in the middle group of electrolysis tanks. In spite of this, however, a sufficiently high coating weight of chromium oxide is generated in the coating, since even at the lower current densities $j_1$ and $j_2$, which are set in the first and in the second electrolysis tank and in the front and the middle group of electrolysis tanks, respectively, a certain amount of chromium oxide has already been deposited on the metal substrate. The major proportion of chromium oxide is deposited in the last electrolysis tank, as viewed in the strip travel direction, or in the rear group of electrolysis tanks, since in these tanks, the high current density $j_3$ is set to a setting at which the proportion chromium oxide relative to the total deposited weight of the coating is higher.

Since already in the first electrolysis tank or in the front group of electrolysis tanks and in the second electrolysis tank or in the middle group of electrolysis tanks, a certain proportion of the total coating weight of the deposited coating amounting to approximately 9% to 25% is attributable to chromium oxide, chromium oxide crystals form on the surface of the metal strip already in the first electrolysis tank or in the front group of electrolysis tanks and in the second electrolysis tank or in the middle group of electrolysis tanks. In the last electrolysis tank and/or in the rear group of electrolysis tanks, these chromium oxide crystals act as a nuclear cell for the growth of additional oxide crystals, which explains why the efficiency of the deposition of chromium oxide or, more specifically, the proportion of chromium oxide of the total deposition weight of the coating increases in the last electrolysis tank or in the rear group of electrolysis tanks. Thus, while saving energy by using lower current densities $j_1$ and $j_2$ in the first and second electrolysis tank and in the front and middle group of electrolysis tanks, respectively, it is possible to generate a sufficiently high coating weight of chromium oxide of preferably more than 5 mg/m$^2$ on the surface of the metal strip.

Because of the oxygen content of the coating, which is higher than that achieved during the electrolytic deposition at higher current densities (and, consequently, a lower oxide content), the chromium oxide content generated in the first electrolysis tank or in the front group of electrolysis tanks and in the second electrolysis tank or in the middle group of electrolysis tanks forms a denser coating, which leads to an improved corrosion resistance.

The use of at least three successively arranged electrolysis tanks makes it possible to maintain a high strip travel speed at the lowest possible current densities, which increases the efficiency of the process. It has been found that to maintain a preferred strip travel speed of at least 100 m/min, a current density of at least 25 A/dm$^2$ is required for a deposition of a chromium/chromium oxide layer to take place at least on one surface of the metal strip. This current density of 25 A/dm$^2$ represents the first current density threshold at a strip travel speed of approximately 100 m/min, which separates Regime I (no chromium deposition) from Regime II (chromium deposition with a linear relationship between the current density and the coating weight of chromium of the deposited coating).

The current densities ($j_1$, $j_2$, $j_3$) in the electrolysis tanks are each adjusted to the strip travel speed, wherein at least substantially a linear relationship between the strip travel speed and the respective current density ($j_1$, $j_2$, $j_3$) exists. It is advantageous if the current density in the first electrolysis tank or in the front group of electrolysis tanks is lower than in the second electrolysis tank or in the middle group of electrolysis tanks. A lower current density in the first electrolysis tank or in the front group of electrolysis tanks generates a dense and therefore corrosion-resistant chromium/chromium oxide coating with a relatively high chromium oxide content, which is preferably greater than 8%, more preferably between 8% and 15%, and most preferably greater than 10 wt %, directly on the surface of the metal strip.

To generate the current densities ($j_1$, $j_2$, $j_3$) in the electrolysis tanks, preferably a pair of anodes with two anodes arranged opposite to one another is disposed in each electrolysis tank, with the metal strip passing between the opposite anodes of a pair of anodes. This allows the current density to be uniformly distributed around the metal strip. Here, it is preferable if the pair of anodes of each electrolysis tank can be charged with electric current independently of each other, thereby allowing different current densities ($j_1$, $j_2$, $j_3$) to be set in the electrolysis tanks.

To be able to set a high current density $j_3$ in the last electrolysis tank, as viewed in the strip travel direction, at least one pair of anodes can be disposed therein, which pair of anodes has a shorter length in the strip travel direction than the pairs of anodes in the preceding electrolysis tanks. This allows all anode pairs to be operated with the same amount of electric current, yet the current density $j^3$ [sic; $j_3$] in the last electrolysis tank can be set higher than the current density in the preceding electrolysis tanks. In addition, by using a shortened pair of anodes in the last electrolysis tank, the anodes can be coupled to a rectifier that has a lower rectifier capacity.

The strip travel speed of the metal strip is preferably such that in each of the electrolysis tanks, the electrolysis time ($t_E$), during which the metal strip is in electrolytically effective contact with the electrolyte solution, is less than 2.0 seconds, specifically between 0.5 and 1.9 seconds, and preferably less than 1.0 second, specifically between 0.6 seconds and 0.9 seconds. This ensures a higher process efficiency, on the one hand, and the deposition of a coating with a sufficiently high coating weight of chromium of preferably at least 40 $mg/m^2$ and specifically between 70 $mg/m^2$ and 180 $mg/m^2$ in the deposited coating, on the other hand. The proportion of chromium oxide of the total coating weight of the deposited coating is at least 5%, preferably more than 10%, and specifically between 11% and 16%. A short electrolysis time of less than 1 second in each of the electrolysis tanks (at unvarying current density) promotes the formation of chromium oxide and inhibits the formation of von metallic chromium, which explains why maintaining short electrolysis times ($t_E$) is also to be preferred on account of ensuring the formation of a coating with the highest possible chromium oxide content.

The total electrolysis time ($t_E$), during which the metal strip is in electrolytically effective contact with the electrolyte solution (E), averaged across all of the electrolysis tanks (1*c*-1*h*), is preferably less than 16 seconds and is specifically between 3 and 16 seconds. Most preferably, the total electrolysis time is less than 8 seconds and is specifically between 4 seconds and 7 seconds.

Because of the configuration of the electrolysis tanks, through which the metal strip is passed in the strip travel direction, a layer-by-layer deposition of the coating takes place, with a layer of varying coating composition, in particular with a varying chromium oxide content in each respective layer, being generated in each of the electrolysis tanks depending on the current density used in each respective electrolysis tank. Thus, for example, it is possible for a chromium metal- and chromium oxide-containing layer with a chromium oxide content of more than 5%, in particular from 6% to 15%, to be deposited on the surface of the metal strip in the first electrolysis tank or in the front group of electrolysis tanks, and for a chromium metal- and chromium oxide-containing layer with a chromium oxide content of less than 5%, in particular from 1% to 3%, to be deposited in the second electrolysis tank or in the middle group of electrolysis tanks. At the high current density $j_3$ in the third electrolysis tank or in the rear group of electrolysis tanks, invariably a layer with a higher chromium oxide content is deposited, where the higher chromium oxide content is preferably more than 40% and particularly between 50% and 80%.

To achieve a sufficiently high corrosion resistance, the coating applied from the electrolyte solution and containing at least the constituents chromium metal and chromium oxide and optionally also chromium sulphates and chromium carbides preferably has an overall coating weight portion of chromium of at least 40 $mg/m^2$ and specifically between 70 $mg/m^2$ and 180 $mg/m^2$, where the proportion of chromium oxide contained in the total weight of chromium deposited in the coating is at least 5%, preferably between 10% and 15%. In the chromium oxide portion, the chromium bound as chromium oxide in the coating is at least 3 mg of Cr per $m^2$, specifically between 3 and 15 $mg/m^2$, and preferably at least 7 mg of Cr per $m^2$.

In the method according to the present disclosure, conveniently, only a single electrolyte solution is used, i.e., all of the electrolysis tanks are filled with the same electrolyte solution, and preferably, both the composition and the temperature of the electrolyte solution are at least substantially the same in all electrolysis tanks. With respect to the temperature of the electrolyte solution, a (mean) temperature of less than 40° C. in all electrolysis tanks was found to be appropriate to ensure the deposition of a coating with the highest possible chromium oxide content. It has been shown that at temperatures of the electrolyte solution of up to 40° C., the formation of chromium oxide is promoted and the formation of metallic chromium is suppressed. In addition, it is also possible for the temperatures of the electrolyte solution in the electrolysis tanks to be set to different settings. For example, to obtain a coating with the highest possible chromium oxide content, the temperature setting of the last electrolysis tank or the rear group of electrolysis tanks can be lower than that of the first and second electrolysis tanks and in the front and middle group of electrolysis tanks, respectively. Thus, for example, the (mean) temperature of the electrolyte solution in the last electrolysis tank or in the rear group of electrolysis tanks can be between 20° C. to less than 40° C., preferably from 25° C. to 38° C., and most preferably 35° C., and the temperature of the electrolyte solution in the electrolysis tanks preceding the last electrolysis tank can be higher, in particular between 40° C. and 70° C., and can preferably be 55° C.

In this context, any reference to the temperature of the electrolyte solution or to the temperature in an electrolysis tank is intended to signify the mean temperature which results as the average of the overall volume of an electrolysis tank. As a rule, there is a temperature gradient with the temperature increasing from top to bottom in the electrolysis tanks.

A preferred composition of the electrolyte solution comprises basic Cr(III) sulfate ($Cr_2(SO_4)_3$) as a trivalent chromium compound. Both in this preferred composition and in other compositions, the concentration of the trivalent chromium compound in the electrolyte solution is at least 10 g/L and preferably higher than 15 g/L and more preferably at least 20 g/L. Other useful constituents of the electrolyte solution may include complexing agents, in particular an alkali metal carboxylate, preferably a salt of formic acid, in particular potassium formate or sodium formate. The ratio of the proportion by weight of the trivalent chromium compound to the proportion by weight of the complexing agents, in particular, the formates, is preferably between 1:1.1 and 1:1.4 and more preferably between 1:1.2 and 1:1.3 and most preferably 1:1.25. To increase the conductivity, the electrolyte solution may contain an alkali metal sulfate, preferably potassium sulfate or sodium sulfate. The electrolyte solution is preferably free of halides, especially free of chloride ions and bromide ions, and free of a buffering agent and especially free of a boronic acid buffer.

The pH value of the electrolyte solution (measured at a temperature of 20° C.) is preferably between 2.0 and 3.0 and more preferably between 2.5 and 2.9 and most preferably 2.7. To adjust the pH value of the electrolyte solution, an acid, for example, sulfuric acid, can be added to the solution.

After the electrolytic deposition of the coating, an organic coating, especially a paint or a thermoplastic material, for example, a polymer film of PET, PE, PP or a mixture thereof, can be applied to the surface of the coating of chromium metal and chromium oxide so as to provide additional protection against corrosion and a barrier against acid-containing filling agents contained in packaging materials.

The metal strip involved can be an (initially uncoated) steel strip (tin-free steel strip) or a steel strip coated with tin (tinplate strip).

BRIEF DESCRIPTION OF THE DRAWINGS

The present disclosure will be described in greater detail with reference to the appended drawings and based on the following embodiment examples, which are merely intended to explain the disclosure by way of example, without in any way limiting the scope of protection defined by the following claims. The drawings show:

DETAILED DESCRIPTION

Figure 1:
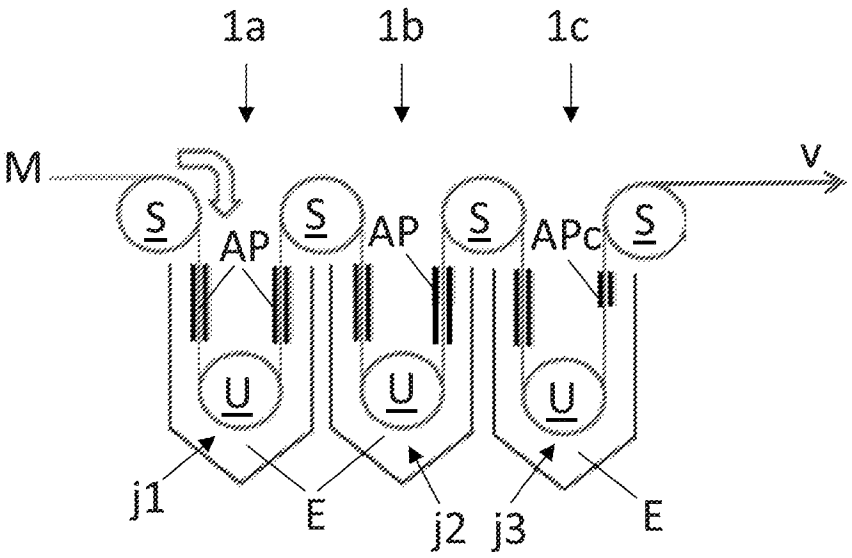
FIG. 1: a diagrammatic representation of a strip coating system for carrying out the method disclosed by the present disclosure in a first embodiment with three electrolysis tanks which are successively arranged in the strip travel direction v.

FIG. 1 shows a diagrammatic representation of a strip coating system for carrying out the method disclosed by the present disclosure in a first embodiment. The strip coating system comprises three electrolysis tanks 1*a*, 1*b*, 1*c* which are arranged side by side or one after another and which are each filled with an electrolyte solution E. An initially uncoated metal strip M is passed successively through the electrolysis tanks 1*a*-1*c*. To this end, by means of a conveyor device (not shown), the metal strip M is pulled at a predefined strip travel speed through the electrolysis tanks 1*a*-1*c* in the strip travel direction v. Disposed above the electrolysis tanks 1*a*-1*c* are conductor rollers S, by means of which the metal strip M is connected as the cathode. Also disposed in each electrolysis tank is a guide roller U, around which the metal strip M is guided and thereby moved into and out of the electrolysis tank.

Within each electrolysis tank 1*a*-1*c*, at least one anode pair AP is disposed below the fluid level of the electrolyte solution E. In the embodiment example shown, two anode pairs AP arranged one after the other are disposed in each electrolysis tank 1*a*-1*c*. The metal strip M is passed through and between the opposing anodes of an anode pair AP. Thus, in the embodiment example of FIG. 1, two anode pairs AP are arranged in each electrolysis tank 1*a*, 1*b*, 1*c* such that the metal strip M is successively passed through these anode pairs AP. The last downstream anode pair APc of the last electrolysis tank 1*c*, as viewed in the strip travel direction v, has a shorter length when compared to the lengths of the other anode pairs AP. As a result, a higher current density can be generated with this last anode pair APc with application of the same amount of electric current.

The metal strip M involved can be an initially uncoated steel strip (tin-free steel strip) or a steel strip coated with tin (tinplate strip). In preparation for the electrolysis process, the metal strip M is first degreased, rinsed, pickled, and rinsed again, and in this pretreated form, it is subsequently passed successively through the electrolysis tanks 1*a*-1*c*, with the metal strip M being connected as the cathode by supplying electric current via the conductor rollers S. The strip travel speed at which the metal strip M is passed through the electrolysis tanks 1*a*-1*c* is at least 100 m/min and may measure up to 900 m/min.

The electrolysis tanks 1*a*-1*c*, which are successively arranged in the strip travel direction v, are each filled with the same electrolyte solution E. The electrolyte solution E contains a trivalent chromium compound, preferably basic Cr(III) sulfate, $Cr_2(SO_4)_3$. In addition to the trivalent chromium compound, the electrolyte solution preferably also contains at least one complexing agent, for example, a salt of formic acid, in particular potassium formate or sodium formate. The ratio of the proportion by weight of the trivalent chromium compound to the proportion by weight of the complexing agents, especially the formates, is preferably between 1:1.1 and 1:1.4 and is most preferably is 1:1.25. To increase conductivity, the electrolyte solution E may contain an alkali metal sulfate, for example, potassium sulfate or sodium sulfate. The concentration of the trivalent chromium compound in the electrolyte solution E is at least 10 g/L and most preferably is 20 g/L or more. The pH value of the electrolyte solution is adjusted to a preferred value between 2.0 and 3.0 and specifically to a pH=2.7 by adding an acid, for example, sulfuric acid.

The temperature of the electrolyte solution E is conveniently the same in all electrolysis tanks 1*a*-1*c* and is preferably between 25° C. and 70° C. However, in especially preferred embodiment examples of the method according to the present disclosure, it is possible to set the temperatures of the electrolyte solution in the electrolysis tanks 1*a*-1*c* to different settings. For example, the temperature of the electrolyte solution of the last electrolysis tank 1*c* can be lower than that of the electrolysis tanks 1*a* and 1*b* disposed upstream thereto. In this embodiment of the method, the temperature of the electrolyte solution in the last electrolysis tank 1*c* is preferably between 25° C. and 38° C. and most preferably measures 35° C. In this embodiment example, the temperature of the electrolyte solution in the first two electrolysis tanks 1*a*, 1*b* is preferably between 40° C. and 75° C. and most preferably measures 55° C. Because of the lower temperature of the electrolyte solution E in the electrolysis tank 1*c*, the deposition of a chromium/chromium oxide layer with a higher chromium oxide content is promoted.

The anode pairs AP disposed in the electrolysis tanks 1*a*-1*c* are supplied with electric direct current such that there is a different current density in each of the electrolysis tanks 1*a*, 1*b*, 1*c*. The first electrolysis tank 1*a*, located upstream as viewed in the strip travel direction v, has a low current density $j_1$; the second electrolysis tank 1*b*, following in the strip travel direction, has a medium current density $j_2$; and the last electrolysis tank 1*c*, as viewed in the strip travel direction, has a high current density $j_3$, where $j_1<j_2<j_3$ and the low current density $j_1>20$ A/dm$^2$.

Because of the current density set in each respective electrolysis tank, a chromium- and chromium oxide-containing layer is electrolytically deposited on at least one side of the metal strip M, thereby generating a layer B1, B2, B3 in each of the electrolysis tanks. Because of the different current densities $j_1$, $j_2$, $j_3$ in the individual electrolysis tanks 1*a*, 1*b*, 1*c*, each electrolytically deposited layer B1, B2, B3 has a different composition, which differ in terms of the chromium oxide content.

Figure 3:
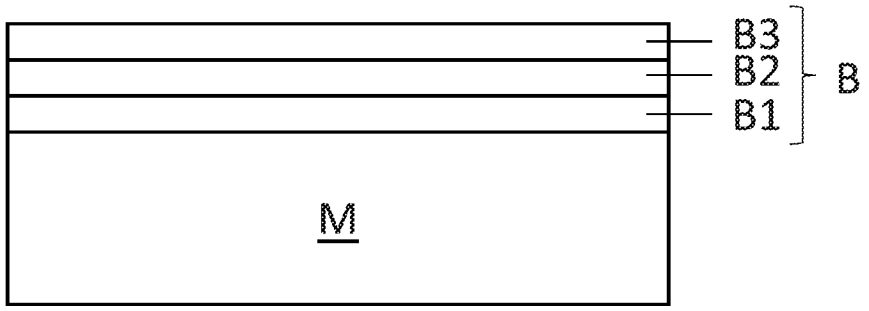
FIG. 3: a sectional view of a metal strip coated by means of the method disclosed by the present disclosure in a first embodiment.

FIG. 3 diagrammatically shows a sectional view of a metal strip M which has been electrolytically coated using the method according to the present disclosure. On one side of the metal strip M, a coating B has been deposited, which is composed of the individual layers B1, B2, B3. Each individual layer B1, B2, B3 is applied to the surface in one of the electrolysis tanks 1*a*, 1*b*, 1*c*.

The coating B, which is composed of the individual layers B1, B2, B3, contains metallic chromium (chromium metal) and chromium oxides (CrOx) as its major constituents, with the composition of the individual layers B1, B2, B3 relative to the respective proportions by weight of chromium metal and chromium oxide differing as a result of the different respective current densities $j_1$, $j_2$, $j_3$ in the electrolysis tanks 1*a*, 1*b*, 1*c*.

Figure 4:
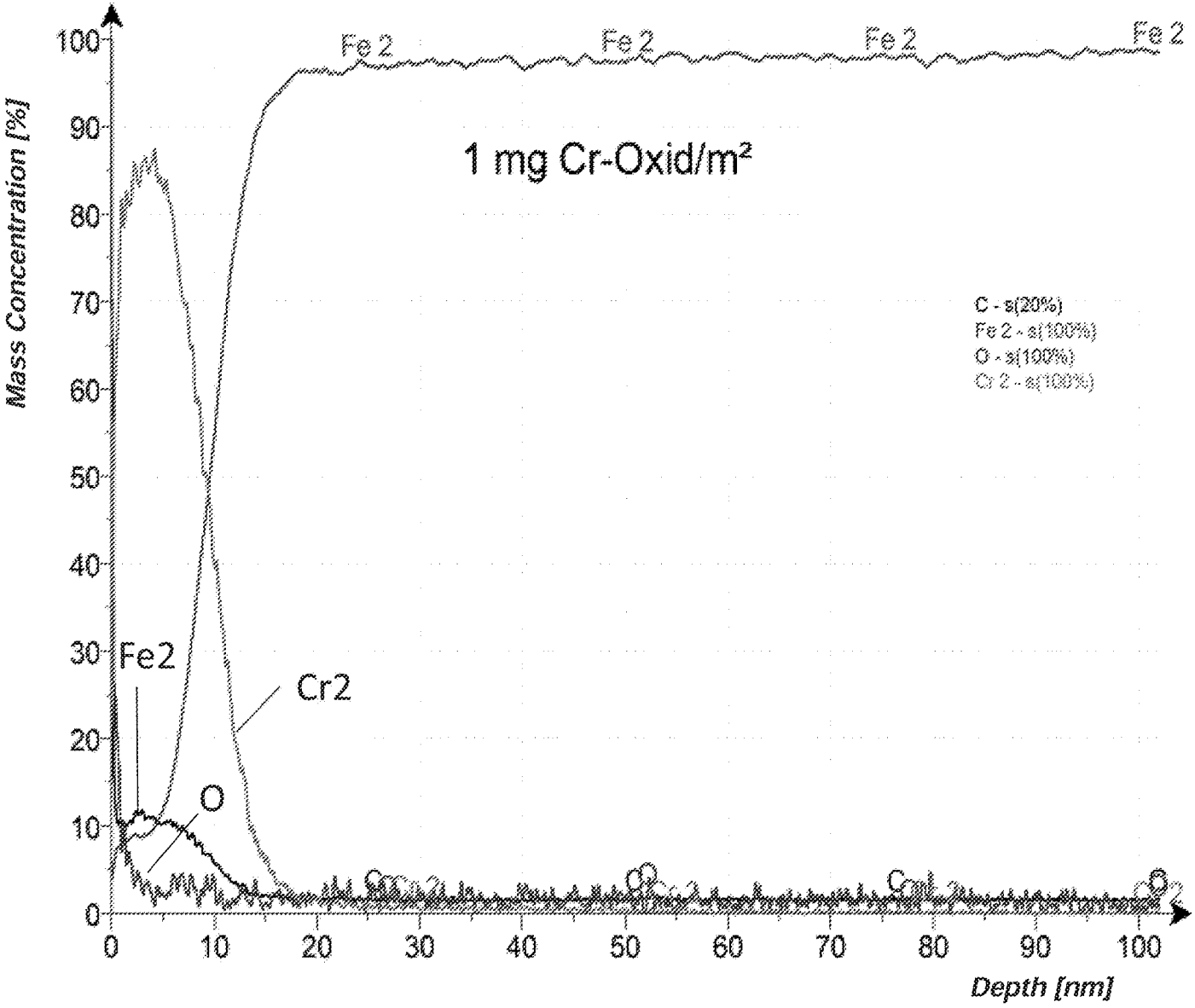
FIG. 4: a GDOES spectrum of a layer electrolytically deposited on a steel strip and containing chromium metal, chromium oxide and chromium carbides, where the chromium oxide is located on the layer surface.

The layer structure of the layers deposited on the metal substrate can be determined by means of GDOES spectra (Glow Discharge Optical Emission Spectroscopy). A metallic chromium layer with a thickness of 10-15 nm is first deposited on the metal strip substrate. The surface of this layer oxidizes and is present mainly as chromium oxide in the form of $Cr_2O_3$ or as a mixed oxide/hydroxide in the form of $Cr_2O_2(OH)_2$. This oxide layer is only a few nanometers thick. In addition, chromium carbon and chromium sulfate compounds, which are uniformly integrated through the entire layer, are formed as a result of the reduction of the organic complexing agent and the sulfate of the electrolyte solution. Typical GDOES spectra of the layers B1, B2, B3 that were deposited in the individual tanks show a considerable increase in the oxygen signal in the first nanometers of the layer, which leads to the conclusion that the oxide layer on the surface of the respective layer is concentrated (FIG. 4).

Depending on the strip travel speed, the metal strip M, which is connected as the cathode and which is passed through the electrolysis tanks 1*a*-1*c*, is in electrolytically effective contact with the electrolyte solution E during an electrolysis time $t_E$. At strip travel speeds between 100 and 700 m/min, the electrolysis time in each of the electrolysis tanks 1*a*, 1*b*, 1*c* measures from 0.5 to 2.0 seconds. Preferably, the strip travel speeds are set sufficiently high that the electrolysis time $t_E$ in each electrolysis tank 1*a*, 1*b*, 1*c* is less than 2 seconds and, in particular, is between 0.6 seconds and 1.8 seconds. Accordingly, the total electrolysis time, during which the metal strip M is in electrolytically effective contact with the electrolyte solution E across all electrolysis tanks 1*a*-1*c*, is between 1.8 and 5.4 seconds.

Due to the low current density $j_1$ in the first electrolysis tank 1*a*, the layer B1 deposited in the first electrolysis tank 1*a*, in comparison with the layer B2 deposited in the second (middle) electrolysis tank 1*b*, has a higher oxide content, since at lower current densities, which occur in Regime II, lead to higher oxide levels in the coating. In the last electrolysis tank 1*c*, a current density $j_3$ is set, which is present in Regime III, in which the chromium oxide content generated in the coating is increased, which is preferably greater than 40 wt % and most preferably greater than 50 wt %.

By way of an example, Table 1 lists suitable current densities $j_1$, $j_2$, $j_3$ in the individual tanks electrolysis tanks 1*a*, 1*b*, 1*c* at different strip travel speeds. As Table 1 indicates, the current densities $j_1$ in the first electrolysis tank 1*a* are slightly lower than the current densities $j_2$ in the second electrolysis tank 1*b*, and are above a lower limit value of $j_0$=20 A/dm$^2$. The current densities $j_1$, $j_2$ in the first two electrolysis tanks 1*a*, 1*b* are the current densities of Regime II in which there is a linear relationship between current density and the amount of electrolytically deposited chromium (or coating weight of chromium in the deposited coating). The current density $j_1$ used in the first electrolysis tank 1*a* is preferably such that it is close to the first current density threshold, which separates Regime I (in which a deposition of chromium does not yet occur) from Regime II. At these low current densities $j_1$, a chromium metal/chromium oxide coating (layer B1) is deposited on the surface of the metal strip M with a higher chromium oxide content than at the higher current densities of Regime II. Therefore, the layer B1, which is deposited in the first electrolysis tank 1*a*, has a higher chromium oxide content than the coating B2, which is deposited in the second electrolysis tank 1*b*.

In the last electrolysis tank 1*a*, the current density $j_3$ is set that it is above the second current density threshold, which separates Regime II from Regime III. The current density $j_3$ of the last electrolysis tank 1*c* is thus in Regime III, in which a partial decomposition of the chromium metal/chromium oxide coating takes place and a considerably higher proportion chromium oxide is deposited than at the current densities in Regime II. Therefore, the coating B3, which is deposited in the last electrolysis tank 1*c*, has a high chromium oxide content which is greater than the chromium oxide content of the coatings B1 and B2.

After the electrolytic deposition of the coating, the metal strip M coated with the coating B is rinsed, dried and oiled (for example, with DOS oil). Subsequently, an organic cover coat can be applied to the surface of the coating B on the metal strip M which has been electrolytically coated with the coating B. The organic cover coat may be, for example, an organic paint or polymer films of thermoplastic polymers, such as PET, PP or mixtures thereof. The organic cover coat can be applied by means of a coil coating method or a panel coating method, with the coated metal strip in the panel coating method first being divided into panels which are subsequently painted with an organic paint or coated with a polymer film.

Figure 2:
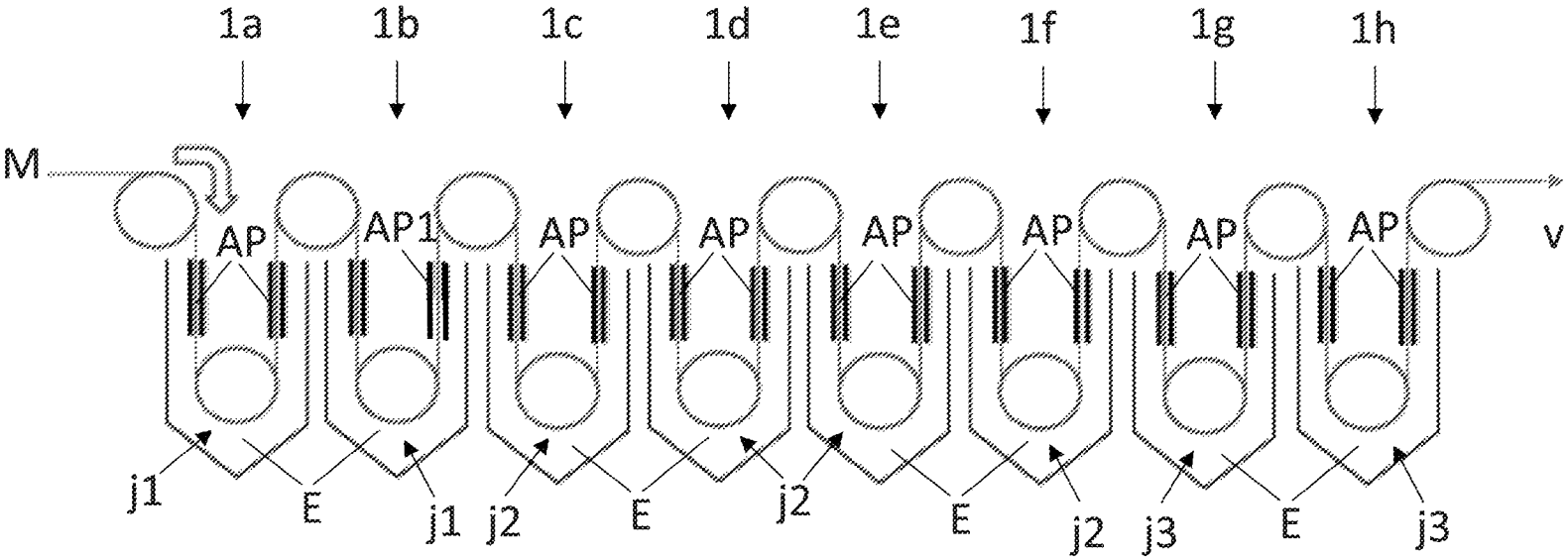
FIG. 2: a diagrammatic representation of a strip coating system for carrying out the method disclosed by the present disclosure in a second embodiment with eight electrolysis tanks which are successively arranged in the strip travel direction v.

FIG. 2 shows a second embodiment of a strip coating system with eight electrolysis tanks 1*a*-1*h*, which are successively connected in the strip travel direction v. The electrolysis tanks 1*a*-1*h* are arranged in three groups, i.e., a front group with the two first electrolysis tanks 1*a*, 1*b*, a middle group with the electrolysis tanks 1*c*-1*f* that follow in the strip travel direction, and a rear group with the two last electrolysis tanks 1*g* and 1*h*. The groups of electrolysis tanks have different current densities $j_1$, $j_2$, $j_3$, wherein the front group of electrolysis tanks 1*a*, 1*b* has a low current density $j_1$, the middle group of electrolysis tanks 1*c*-1*f* has a medium current density $j_2$, and the rear group of electrolysis tanks 1*g*, 1*h* has a high current density $j_3$, where $j_1<j_2<j_3$ and the low current density $j_1$>20 A/dm$^2$.

In the front group of electrolysis tanks 1*a*, 1*b*, a chromium- and chromium oxide-containing layer B1, in the second group of electrolysis tanks 1*c*-1*f*, a second layer B2, and in the rear group of electrolysis tanks 1*g*, 1*h*, a third layer B3 is electrolytically deposited on the metal strip M. As in the embodiment example of FIG. 1, because of the different current densities $j_1$, $j_2$, $j_3$ in the successively arranged electrolysis tanks, the layers B1, B2, B3 have different compositions, with the layer B1 containing a higher chromium oxide content than the second layer B2, and with the third layer B3 containing a higher chromium oxide content than the two layers B1 and B2.

Like Table 1, Table 2 lists exemplary and suitable current densities $j_1$, $j_2$, $j_3$ in the individual electrolysis tanks 1*a* to 1*h* at different strip travel speeds v, wherein the electrolysis tanks 1*a*, 1*b* of the front group are set to a low current density $j_1$, the electrolysis tanks 1*c* to 1*f* of the middle group are set to a medium current density $j_2$, and the electrolysis tanks 1*g*, 1*h* of the last group are set to a high current density $j_3$, where $j_1<j_2<j_3$.

Thus, the coating B produced on the surface of the metal strip M by means of the method disclosed by the present disclosure in the strip coating system of FIG. 2 has essentially the same composition and structure as shown in FIG. 3.

Since the strip coating system of FIG. 2 comprises a larger number of electrolysis tanks, which is necessarily associated with an increase in the total electrolysis time, during which the metal strip, which is connected as the cathode, is in electrolytically effective contact with the electrolyte solution E, it is possible for the coatings B to be produced with higher coating weights.

To achieve a sufficiently high corrosion resistance, the total weight of chromium deposited in the coating B is preferably at least 40 mg/m$^2$ and more preferably between 70 mg/m$^2$ and 180 mg/m$^2$. The proportion of chromium oxide contained in the total weight of deposited chromium, averaged across the total weight of the coating B, is at least 5% and is preferably between 10% and 15%. Overall, the coating B preferably has a chromium oxide content with a deposited weight of chromium bound as chromium oxide of at least 3 mg of chromium per m$^2$ and particularly 3 to 15 mg/m$^2$. The deposited weight of chromium bound as chromium oxide, averaged across the total surface area of the coating B, is at least 7 mg of chromium per m$^2$. Good adhesion of organic paints or thermoplastic polymer materials to the surface of the coating B can be achieved with chromium oxide weights of up to approximately 15 mg/m$^2$. Therefore, a preferred range for the coating weight of chromium oxide in the coating B is between 5 and 15 mg/m$^2$.

In the embodiment example of FIG. 2, the total electrolysis time, during which the metal strip M is in electrolytically effective contact with the electrolyte solution E, averaged across all electrolysis tanks 1*a*-1*h*, is preferably less than 16 seconds and more specifically between 4 and 16 seconds.

TABLE 1

Current densities $j_1$, $j_2$, $j_3$ in the individual electrolysis tanks of the first embodiment example (with 3 electrolysis tanks 1a-1c) at different strip travel speeds V:

| Tank v [m/min] | 1a $J_1$/[A/dm$^2$] | 1b $J_2$/[A/dm$^2$] | 1c $J_3$/[A/dm$^2$] |
|---|---|---|---|
| 100 | 25 | 29 | 75 |
| 150 | 41 | 45 | 91 |
| 200 | 57 | 61 | 107 |
| 300 | 73 | 77 | 133 |
| 400 | 89 | 93 | 149 |
| 500 | 105 | 109 | 165 |

TABLE 2

Current densities $j_1$, $j_2$, $j_3$ in the individual electrolysis tanks of the second embodiment example (with 8 electrolysis tanks 1a-1h which are arranged in three groups) at different strip travel speeds v:

| Tank v [n/min] | 1a $J_1$/[A/dm$^2$] | 1b $J_1$/[A/dm$^2$] | 1c $J_2$/[A/dm$^2$] | 1d $J_2$/[A/dm$^2$] | 1e $J_2$/[A/dm$^2$] | 1f $J_2$/[A/dm$^2$] | 1g $J_3$/[A/dm$^2$] | 1h $J_3$/[A/dm$^2$] |
|---|---|---|---|---|---|---|---|---|
| 100 | 25 | 25 | 29 | 29 | 29 | 29 | 75 | 75 |
| 150 | 41 | 41 | 45 | 45 | 45 | 45 | 91 | 91 |
| 200 | 57 | 57 | 61 | 61 | 61 | 61 | 107 | 107 |
| 300 | 73 | 73 | 77 | 77 | 77 | 77 | 133 | 133 |
| 400 | 89 | 89 | 93 | 93 | 93 | 93 | 149 | 149 |
| 500 | 105 | 105 | 109 | 109 | 109 | 109 | 165 | 165 |

What is claimed is:

1. A method for producing a metal strip coated with a coating containing chromium metal and chromium oxide and being electrolytically deposited from an electrolyte solution containing a trivalent chromium compound onto the metal strip by connecting the metal strip as a cathode and bringing the metal strip into electrolytic contact with the electrolyte solution, the method comprising:

successively passing the metal strip at a predefined strip travel speed through a plurality of electrolysis tanks successively arranged in a strip travel direction one behind the other, wherein the plurality of electrolysis tanks comprises a first electrolysis tank, a second electrolysis tank following in the strip travel direction the first electrolysis tank, and a third electrolysis tank following in the strip travel direction the second electrolysis tank;

wherein the first electrolysis tank is at a first current density which is greater than 20 A/dm$^2$ when the metal strip is in the first electrolysis tank; the second electrolysis tank is at a second current density which is equal to or greater than the first current density when the metal strip is in the second electrolysis tank; and the third electrolysis tank is at a third current density which is greater than the second current density when the metal strip is in the third electrolysis tank.

2. The method as in claim 1, further comprising adjusting the current densities in each electrolysis tank of the plurality of electrolysis tanks to the predefined strip travel speed with a linear relationship between the predefined strip travel speed and the respective current density.

3. The method as in claim 1, wherein each electrolysis tank of the plurality of electrolysis tanks includes at least one anode pair with two opposing anodes, wherein the metal strip is passed through the two opposing anodes of each electrolysis tank of the plurality of electrolysis tanks.

4. The method as in claim 1, wherein in each of the electrolysis tanks of the plurality of electrolysis tanks, an electrolysis time, during which the metal strip is in electrolytically effective contact with the electrolyte solution, is less than 2.0 seconds and wherein a total electrolysis time, during which the metal strip is in electrolytically effective contact with the electrolyte solution across the plurality of electrolysis tanks, is less than 16 seconds.

5. The method as in claim 1, wherein the electrolyte solution in each electrolysis tank of the plurality of electrolysis tanks has substantially at least one of a same composition and substantially a same temperature and wherein a mean temperature of the electrolyte solution is less than 40° C.

6. The method as in claim 1, wherein a temperature of the electrolyte solution in the first and second electrolysis tanks is greater than 40° C. and wherein a mean temperature of the electrolyte solution in the third electrolysis tank is between 20° C. and 40° C.

7. The method as in claim 1, wherein the trivalent chromium compound of the electrolyte solution comprises basic Cr(III) sulfate ($Cr_2(SO_4)_3$).

8. The method as in claim 1, wherein the electrolyte solution comprises at least one complexing agent, wherein a ratio of a proportion by weight of the trivalent chromium compound to a proportion by weight of the at least one complexing agent is between 1:1.1 and 1:1.

9. The method as in claim 1, wherein concentration of the trivalent chromium compound in the electrolyte solution is at least 10 g/L and wherein pH value of the electrolyte solution, measured at a temperature of 20° C., is between 2.0 and 3.0.

10. The method as in claim 1, wherein the metal strip is passed through the electrolysis tanks of the plurality of electrolysis tanks at the predefined strip travel speed of at least 100 m/min.

11. The method as in claim 1, wherein the coating deposited from the electrolyte solution has a total coating weight of chromium of at least 40 mg/m$^2$, wherein a proportion of chromium oxide contained in the total weight of deposited chromium is at least 5% and a coating weight of chromium bound as chromium oxide is at least 3 mg of Cr per m$^2$.

12. The method as in claim 1, wherein following electrolytic deposition of the coating, a cover coat of organic material is deposited on the coating of chromium metal and chromium oxide.

13. The method as in claim 1, wherein in the first electrolysis tank, a chromium metal- and chromium oxide-containing coating with a proportion by weight of chromium oxide of more than 5% is deposited on a surface of the metal strip and in the second electrolysis tank, a chromium metal- and chromium oxide-containing coating with a weight proportion of chromium oxide of less than 5% is deposited on the chromium metal- and chromium oxide-containing coating deposited in the first electrolysis tank.

14. The method as in claim 1, wherein in the third electrolysis tank, a chromium metal- and chromium oxide-containing coating with a proportion by weight of chromium oxide of more than 40% is deposited on a chromium metal- and chromium oxide-containing coating deposited in the second electrolysis tank.

15. The method as in claim 1, wherein each electrolysis tank of the plurality of electrolysis tanks includes at least one anode pair having a given length, and wherein the third electrolysis tank includes at least one anode pair which has a shorter length than the length of the anode pairs of the first and second electrolysis tanks.

16. The method as in claim 1, wherein the first current density is indicated by $j_1$, the second current density is indicated by $j_2$, and the third current density is indicated by $j_3$ and wherein $j_3>2\times j_2$.

17. The method as in claim 1, wherein a first coating layer of the coating is electrolytically deposited on the metal strip from the electrolyte solution in the first electrolysis tank, the first coating layer including chromium and chromium oxide, the chromium oxide having a first coating weight; a second coating layer of the coating is electrolytically deposited on the first coating layer from the electrolyte solution in the second electrolysis tank, the second coating layer including chromium and chromium oxide, the chromium oxide having a second coating weight; and a third coating layer of the plurality of coating layers is electrolytically deposited on the second coating layer from the electrolyte solution in the third electrolysis tank, the third coating layer including chromium and chromium oxide, the chromium oxide having a third coating weight higher than the first coating weight and higher than the second coating weight.

18. The method as in claim 1, wherein the third current density is greater than the second current density by at least 46 A/dm$^2$ when the metal strip is in the third electrolysis tank.

19. A method for producing a metal strip coated with a coating containing chromium metal and chromium oxide and being electrolytically deposited from an electrolyte solution containing a trivalent chromium compound onto the metal strip by bringing the metal strip, which is connected as a cathode, into contact with the electrolyte solution, the method comprising:

successively passing the metal strip at a predefined strip travel speed through a plurality of electrolysis tanks successively arranged in a strip travel direction, wherein the plurality of electrolysis tanks comprises a front group of electrolysis tanks including at least one front electrolysis tank; a middle group of electrolysis tanks including at least one middle electrolysis tank; and a rear group of electrolysis tanks including at least one rear electrolysis tank;

wherein the front group of electrolysis tanks is at a first current density which is greater than 20 A/dm$^2$; the middle group of electrolysis tanks, which follows the front group of electrolysis tanks in the strip travel direction, is at a second current density which is equal to or greater than the first current density; and the rear group of electrolysis tanks, which follows the middle group of electrolysis tanks in the strip travel direction, is at a third current density which is greater than the second current density;

wherein in each electrolysis tank there is arranged at least one anode pair with two opposing anodes, wherein the metal strip is passed between and through the two opposing anodes of the at least one anode pair; and wherein the at least one anode pair of the at least one rear electrolysis tank has a shorter length than the at least one anode pairs of the at least one front electrolysis tank and the at least one middle electrolysis tank.

20. A method for producing a metal strip coated with a coating-containing chromium metal and chromium oxide and being electrolytically deposited from an electrolyte solution containing a trivalent chromium compound onto the metal strip by connecting the metal strip as a cathode and bringing the metal strip into electrolytic contact with the electrolyte solution, the method comprising:

successively passing the metal strip at a predefined strip travel speed through a plurality of electrolysis tanks successively arranged in a strip travel direction one behind the other, the plurality of electrolysis tanks comprising a front group of electrolysis tanks, a middle group of electrolysis tanks following in the strip travel direction the front group of electrolysis tanks, and a rear group of electrolysis tanks following in the strip travel direction the middle group of electrolysis tanks, wherein the electrolysis tanks of the front group of electrolysis tanks are at a first current density, which is greater than 20 A/dm$^2$ when the metal strip is in the front group of electrolysis tanks, the electrolysis tanks of the middle group of electrolysis tanks are at a second current density which is equal to or greater than the first current density when the metal strip is in the middle group of electrolysis tanks, and the electrolysis tanks of the rear group of electrolysis tanks are at a third current density which is greater than the second current density when the metal strip is in the rear group of electrolysis tanks.

21. The method as in claim 20, wherein the first current density is indicated by $j_1$, the second current density is indicated by $j_2$, and the third current density is indicated by $j_3$ and wherein $j_3>2\times j_2$.

22. The method as in claim 20, wherein a first coating layer of the coating is electrolytically deposited on the metal strip from the electrolyte solution in the front group of electrolysis tanks, the first coating layer including chromium and chromium oxide, the chromium oxide having a first coating weight; a second coating layer of the coating is electrolytically deposited on the first coating layer from the electrolyte solution in the middle group of electrolysis tanks, the second coating layer including chromium and chromium oxide, the chromium oxide having a second coating weight; and a third coating layer of the plurality of coating layers is electrolytically deposited on the second coating layer from the electrolyte solution in the rear group of electrolysis tanks, the third coating layer including chromium and chromium oxide, the chromium oxide having a third coating weight higher than the first coating weight and higher than the second coating weight.

23. The method as in claim 20, wherein the third current density is greater than the second current density by at least 46 $A/dm^2$ when the metal strip is in the rear group of electrolysis tanks.

* * * * *